US011318474B2

(12) United States Patent
Tracy et al.

(10) Patent No.: US 11,318,474 B2
(45) Date of Patent: May 3, 2022

(54) MILLING SYSTEM AND METHOD

(71) Applicant: PEARSON INCORPORATED, Sioux Falls, SD (US)

(72) Inventors: Josh Tracy, Harrisburg, SD (US); Alex Pearson, Sioux Falls, SD (US); Roy Olson, Sioux Falls, SD (US)

(73) Assignee: Pearson Incorporated, Sioux Falls, SD (US)

( * ) Notice: Subject to any disclaimer, the term of this patent is extended or adjusted under 35 U.S.C. 154(b) by 6 days.

(21) Appl. No.: 16/411,223

(22) Filed: May 14, 2019

(65) Prior Publication Data

US 2020/0188925 A1 Jun. 18, 2020

Related U.S. Application Data

(60) Provisional application No. 62/671,220, filed on May 14, 2018.

(51) Int. Cl.
*B02C 4/32* (2006.01)
*B02C 4/02* (2006.01)

(52) U.S. Cl.
CPC . *B02C 4/32* (2013.01); *B02C 4/02* (2013.01)

(58) Field of Classification Search
CPC ..... B02C 4/02–08; B02C 4/42; B02C 4/32; B02C 4/426; B02C 18/24; B02C 9/04; B02C 11/04
See application file for complete search history.

(56) References Cited

U.S. PATENT DOCUMENTS 5,072,887 A * 12/1991 Thom, Jr. ..... B02C 4/32 241/37
6,685,118 B1 * 2/2004 Williams, Jr. ..... B02C 4/32 241/232
6,722,593 B1 * 4/2004 Dobozy ..... B29B 17/04 241/29
8,720,804 B1 * 5/2014 Pearson ..... B02C 9/04 241/10
10,399,082 B1 * 9/2019 Pearson ..... G01B 7/14
2004/0221633 A1 * 11/2004 Abi-Karam ..... B21B 37/20 72/10.2
2013/0277479 A1 * 10/2013 Reznitchenko ..... B02C 4/283 241/226
2014/0263777 A1 * 9/2014 Anderson, Jr. ..... B02C 25/00 241/30
2016/0107162 A1 * 4/2016 Busenhart ..... B02C 25/00 241/25

(Continued)

FOREIGN PATENT DOCUMENTS

DE 10218424 A1 * 12/2002 ..... B02C 4/42
EP 2103223 A1 * 9/2009 ..... A23G 1/0043

(Continued)

OTHER PUBLICATIONS

DE-10218424-A1 Machine Translation, 2002 (Year: 2002).*
KR-20140112978-A Machine Translation, 2014 (Year: 2014).*

*Primary Examiner* — Jessica Cahill
*Assistant Examiner* — Smith Oberto Bapthelus
(74) *Attorney, Agent, or Firm* — Jeffrey A. Proehl; Woods, Fuller, Shultz & Smith, PC

(57) ABSTRACT

A system and method for operating a milling apparatus with grinding rolls and a variety of sensors sensing various aspects of the milling process.

8 Claims, 13 Drawing Sheets

(56) References Cited

U.S. PATENT DOCUMENTS

| | | | | |
|---|---|---|---|---|
| 2016/0193609 | A1* | 7/2016 | Ellermeijer | A23G 1/0033 241/25 |
| 2017/0043348 | A1* | 2/2017 | Pearson | B02C 4/38 |
| 2018/0259446 | A1* | 9/2018 | Coffey | G01N 21/359 |
| 2018/0369829 | A1* | 12/2018 | Kaartinen | B02C 21/00 |

FOREIGN PATENT DOCUMENTS

| | | | | |
|---|---|---|---|---|
| KR | 20140112978 | A * | 9/2014 | |
| WO | WO-2009043590 | A2 * | 4/2009 | B02C 4/06 |

* cited by examiner

MILLING SYSTEM AND METHOD

REFERENCE TO RELATED APPLICATIONS

This application claims the benefit of U.S. Provisional Patent No. 62/671,220, filed May 14, 2018, which is hereby incorporated by reference in its entirety.

BACKGROUND

Field

The present disclosure relates to milling apparatus and more particularly pertains to a new milling system and method for operating a milling apparatus in a highly autonomous manner.

SUMMARY

The present disclosure relates to a system and method for operating a milling apparatus with grinding rolls and a variety of sensors sensing various aspects of the milling process.

In another aspect, the disclosure relates to an apparatus for reducing sizes of particles entering the apparatus. The apparatus may comprise a frame, and a pair of grinding rolls each having a plurality of grinding teeth thereon with the rolls being separated by a roll gap through which the particles pass. The apparatus may also include a roll support mounting each of the rolls on the frame with at least one of the roll supports being movable with respect to the frame to move the associated roll of the pair of rolls with respect to another roll of the pair of rolls to adjust a size of the roll gap, and a motor configured to rotate at least one of the rolls of the pair of grinding rolls. The apparatus may also include a control assembly configured to control operation of the apparatus, and the control assembly may comprise a sensor assembly including at least one sensor and a sensor interface for receiving data signals from the at least one sensor to sense an aspect of the operation of the apparatus. The control assembly may also comprise an actuator assembly including at least one actuator and an actuator interface for sending command signals to the at least one actuator to make adjustments of elements of the apparatus.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein:

FIGS. 1A through 11 are schematic flow diagrams of an illustrative implementation of a milling method according to the present disclosure.

FIG. 2 is a schematic flow diagram of an illustrative implementation of a subprocess of the milling method for, according to an illustrative embodiment.

FIG. 3 is a schematic flow diagram of an illustrative implementation of a subprocess of the milling method for, according to an illustrative embodiment.

FIG. 4 is a schematic diagram of components of the milling apparatus, according to an illustrative embodiment.

FIG. 5 is a schematic diagram of control elements of the milling apparatus, according to an illustrative embodiment.

DETAILED DESCRIPTION

Figure 1A:
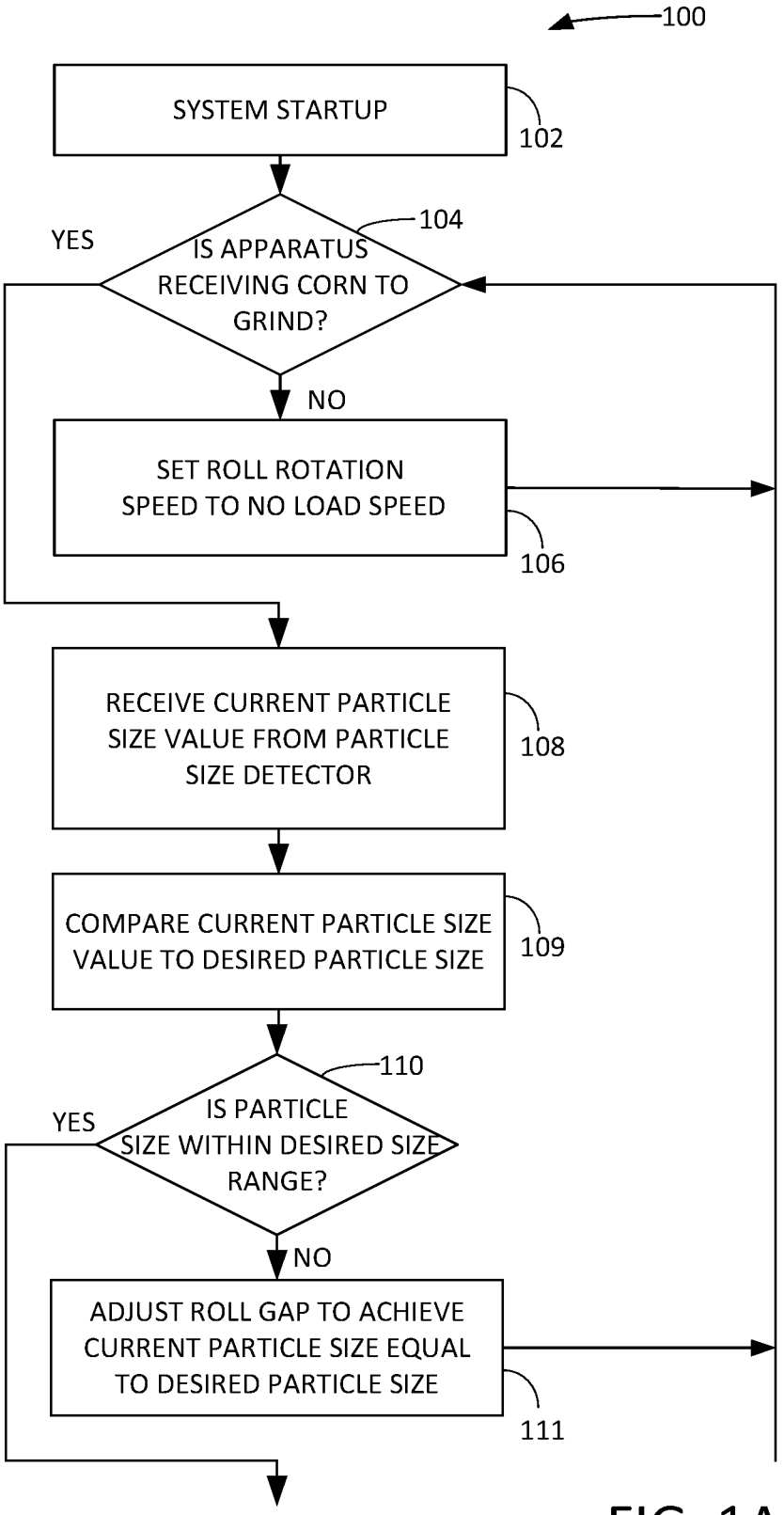
Figure 1B:
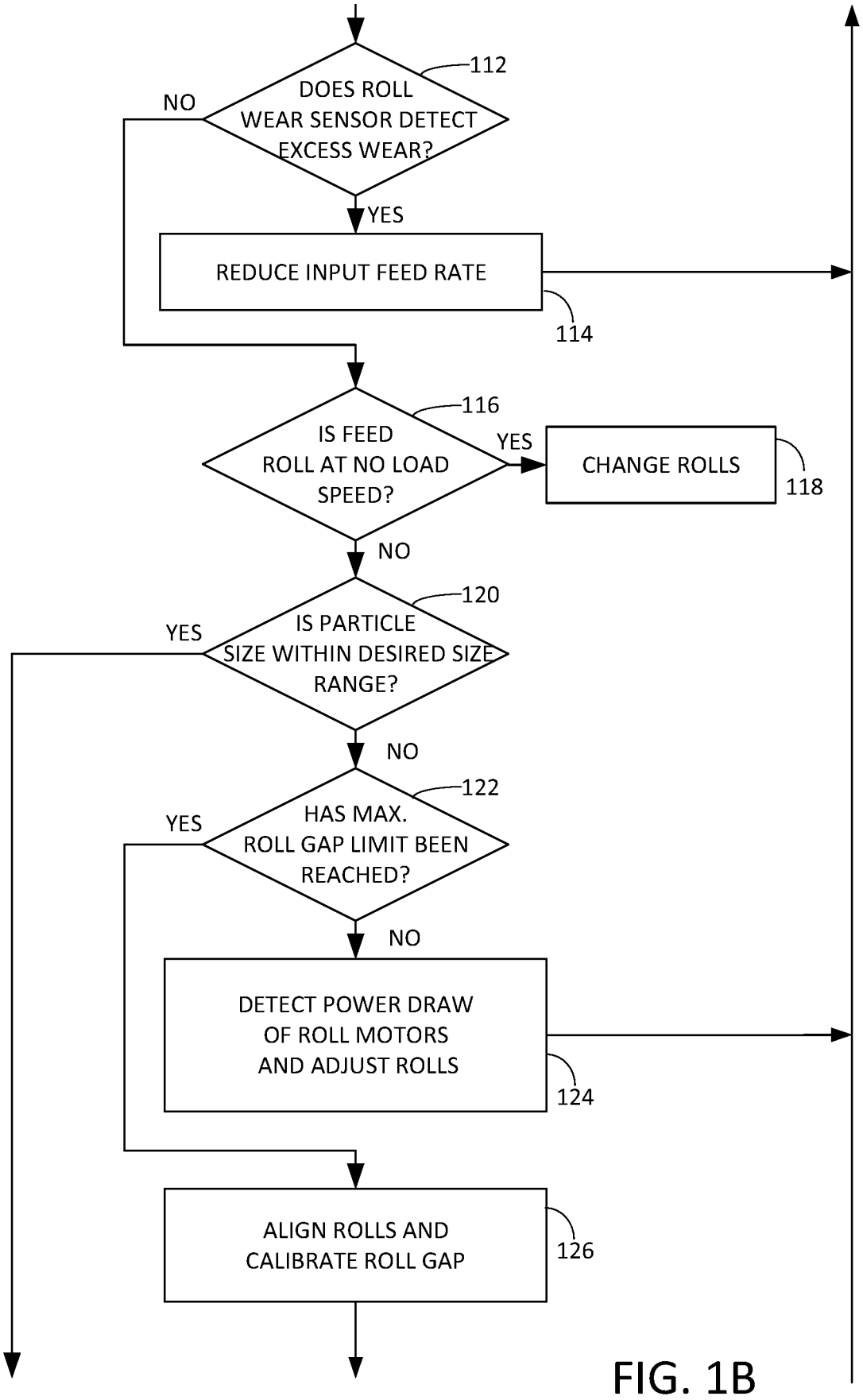

With reference now to the drawings, and in particular to FIGS. 1 through 5 thereof, a new milling system and method embodying the principles and concepts of the disclosed subject matter will be described.

The system 10 generally includes an apparatus 12 for milling or grinding or otherwise reducing the size of the particles entering the apparatus using at least a pair of grinding rolls 14, 16 typically having grinding teeth and being separated by a roll gap 18 through which the particles pass as the particles move through the apparatus 12. Each of the rolls 14, 16 may be supported on a frame 20 of the apparatus 12 by roll supports 15, 17, and the roll support 15 for at least one 14 of the rolls may be movable with respect to the frame by a roll position actuator 22 to adjust the size of the roll gap 18.

The system 10 may also include a control apparatus 30 including a processor 32 (or processors), a display 34 for accomplishing input and output for the apparatus (as well as optionally a keyboard or mouse), a storage 36 for storing or retaining a program of instructions for operation, memory 38 for short-term storage of data such as data entered by the operator of the apparatus, and the storage and/or the memory may be utilized to hold various values for desired settings, tolerances, thresholds, etc. The control apparatus 30 may also include various interfaces, including a sensor interface 40 for receiving data or signals from a variety of sensors or detectors configured to sense or detect various aspects of the operation of the system and transmit sensor signals to the processor for utilization in the operation of the system. Another interface may be an actuator interface 42 for sending signals or commands to the various actuators of the grinding apparatus to make adjustments of various elements of the grinding apparatus.

The various sensors may include, for example, a particle feed sensor 50 for detecting the movement of particles into the apparatus from upstream sources, a particle size detector 52 sensor for detecting a characteristic size of the particles passing through a specific point in the grinding apparatus, a roll wear sensor 54 for sensing a degree of wear on a roll (e.g., reduction in roll diameter), and a roll motor power sensor 56 for detecting the power drawn by a motor that rotates one or more of the rolls of the apparatus. The various controls or actuators may include, for example, a feed roll control 60 for controlling the speed of the feed roll and thus the rate at which particles are fed to the grinding rolls of the apparatus, a motor speed control 62 for controlling the speed at which the roll motor rotates one or more rolls of the apparatus 12, and the roll position actuator 22.

For the purposes of this description, references to determinations made or actions taken by the system may refer to determinations made or actions taken by some or all of these elements collectively, and particularly may refer to signals received by the processor via the sensor interface and commands sent to actuators via the actuator interface. References to a "threshold" value generally indicate a minimum value for a characteristic or parameter which may fall within an acceptable tolerance or variation from a desired or predetermined minimum value. References to a "range" generally indicate a set of desired or intended values between a minimum value and a maximum value for a characteristic or parameter, and such minimum and maximum values may also be subject to acceptable tolerances or variations from the actual minimum and maximum values.

One implementation 100 of a method for operation of the system 10, such as depicted in FIG. 1 beginning with FIG. 1A, is initiated at the startup of the system (block 102) and may include any steps suitable to be taken at the initiation of operation of the system (and not generally repeated during the operation of the system).

As an initial step, a determination is made whether the grinding apparatus 12 is receiving particles (e.g. whole corn) to be ground by the apparatus in the current grinding operation (block 104) by a particle feed sensor 50, and if it is determined that particles are not being received by the apparatus, such as due to some problem with the flow upstream from the apparatus 12, then the rotation speed of the feed roll may be set to a predetermined no-load speed (block 106) for the apparatus, and the process returns to the initial step at block 104.

Figure 2:
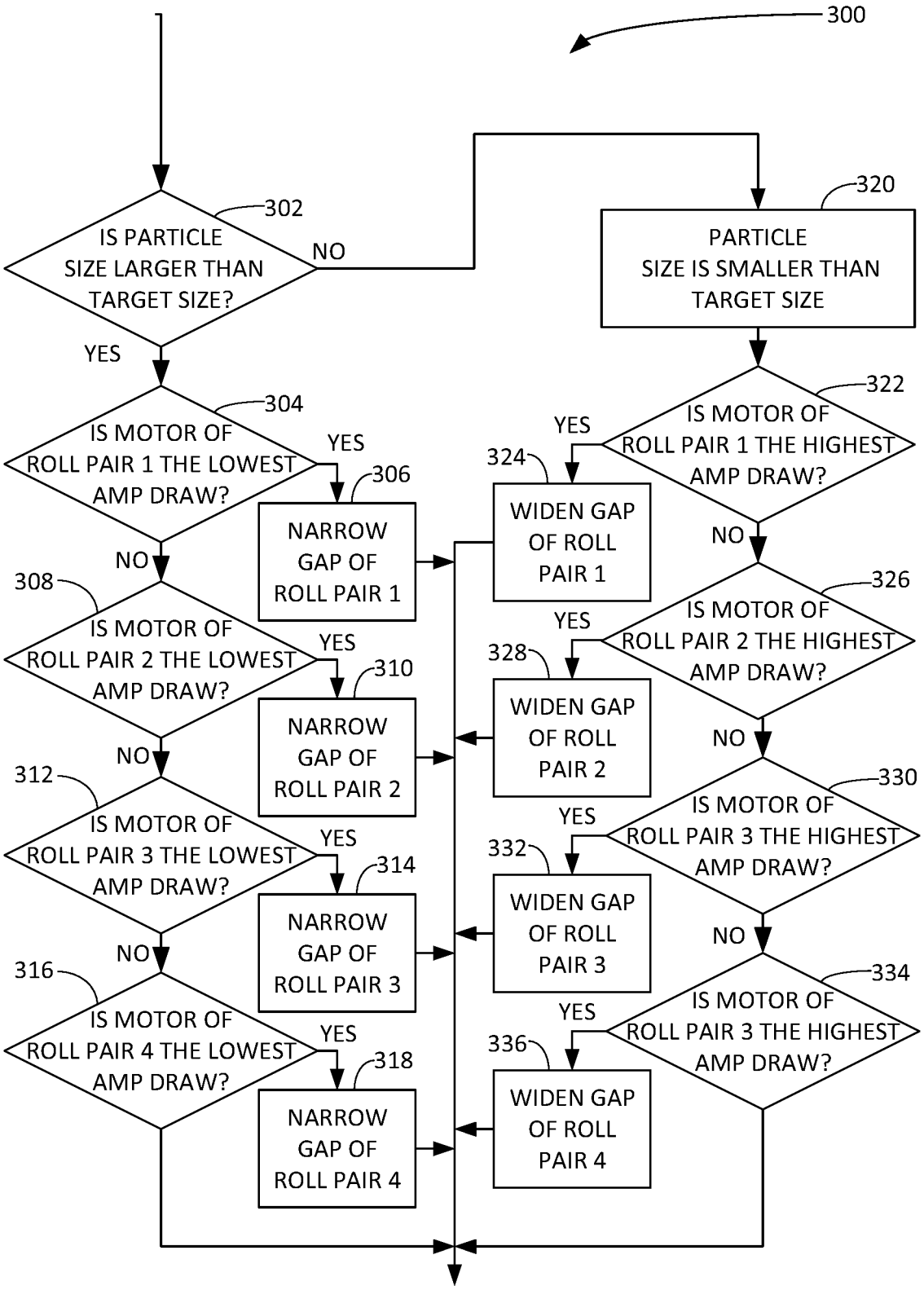

If particle flow to the apparatus 12 is detected (block 104), then the system may receive data from a particle size detector 52 regarding the size characteristics of the particles (block 108) at a particular point in the flow particles through the grinding apparatus, such as the output of the grinding apparatus, and a comparison may be made between the current particle size represented by the data and a desired particle size stored in memory (block 109). If it is determined that the particle size is not within the desired size range (block 110), then a sub process (block 111) to adjust the gap between the rolls of the apparatus 12 may be performed as depicted in FIG. 2.

If it is determined that the size of the particles are within the desired size range (block 110), then a determination may be made as to whether the roll wear sensor 54 detects excess wear on one or more of the grinding rolls (block 112 in FIG. 1B), and if so, the input feed rate at the input of the apparatus is reduced (block 114) via the feed roll speed control 60 and the process is returned to the initial step at block 104. If excess wear is not detected (block 112), then a determination is made whether the feed roll is rotating at a no-load speed (block 116) by monitoring the feed roll speed control. If so, then the system provides information to the operator (via, for example, a display 34) that one or more of the rolls needs to be changed (block 118) and operation of the apparatus may be discontinued for maintenance.

If the feed roll is determined to not be rotating at the no-load speed (block 116), then a determination may be made whether the detected size of the particles is within a desired size range for the current grinding operation (block 120). If so, then the process moves to block 154 in FIG. E. If not, then a determination may be made if the grinding rolls are currently adjusted to the maximum gap permitted between the grinding rolls (block 122), which may be accomplished using a suitable gap sensor or by consulting the most recent gap setting recorded in memory. If not at the maximum gap, then the process moves to a subprocess (block 124) for detecting the power draw of the motors driving the grinding rolls, and adjustment of the roll gap between the rolls, may be performed as depicted in FIG. 2. If it is determined that the grinding rolls are currently adjusted to the maximum gap permitted, then a sub process (block 126) for aligning the rolls, and calibrating the roll gap between the rolls, may be performed as depicted in FIG. 3.

Figure 1C:
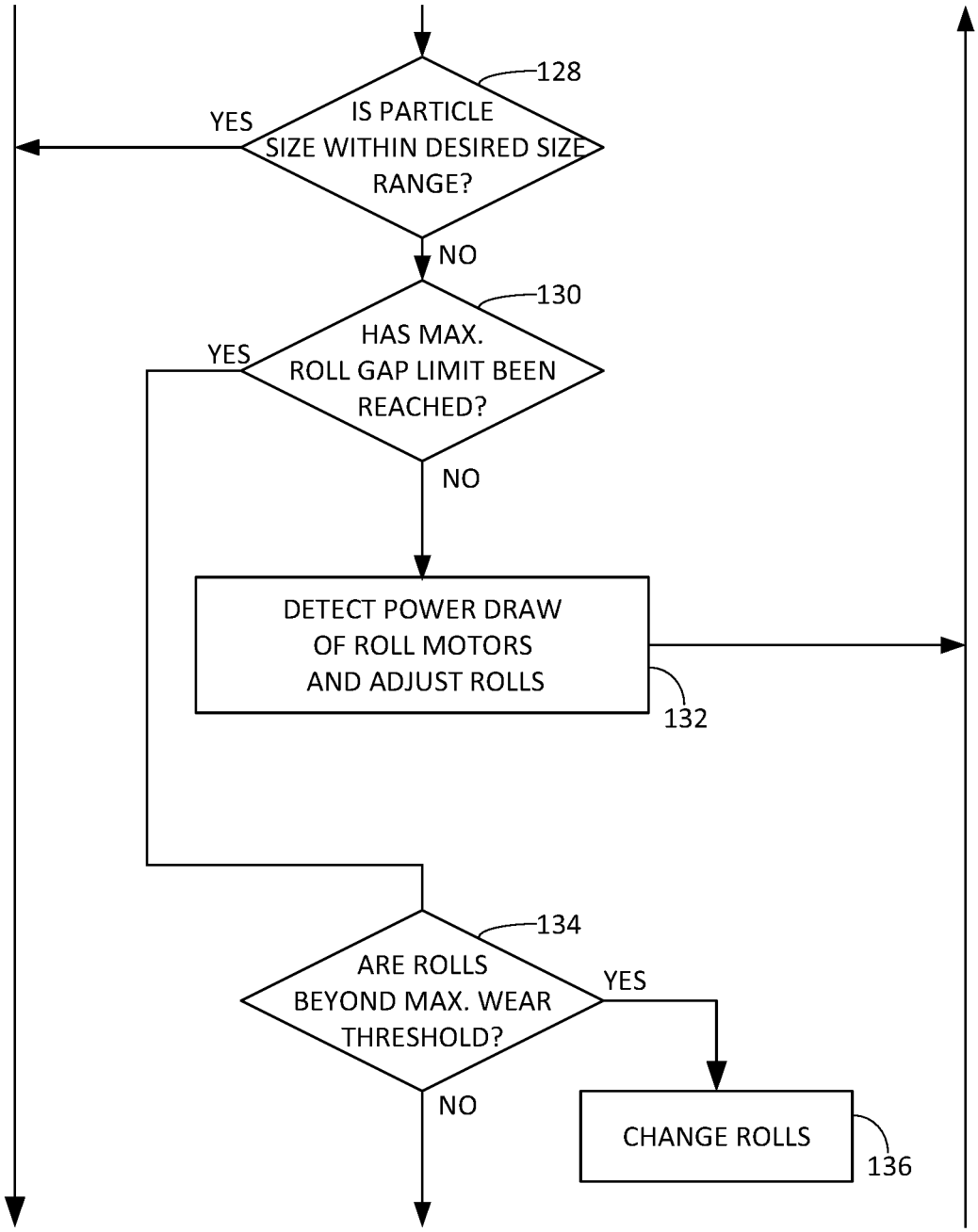
Figure 3:
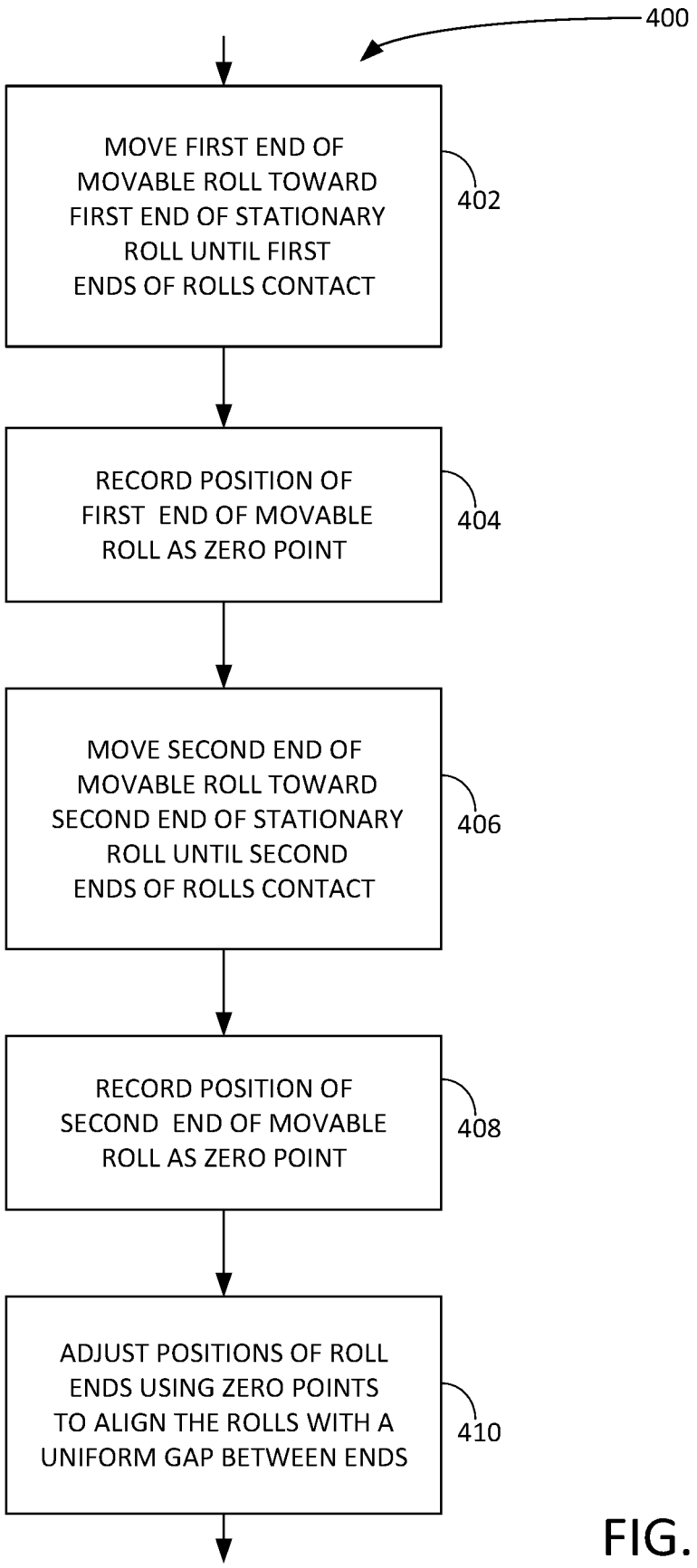
Figure 4:
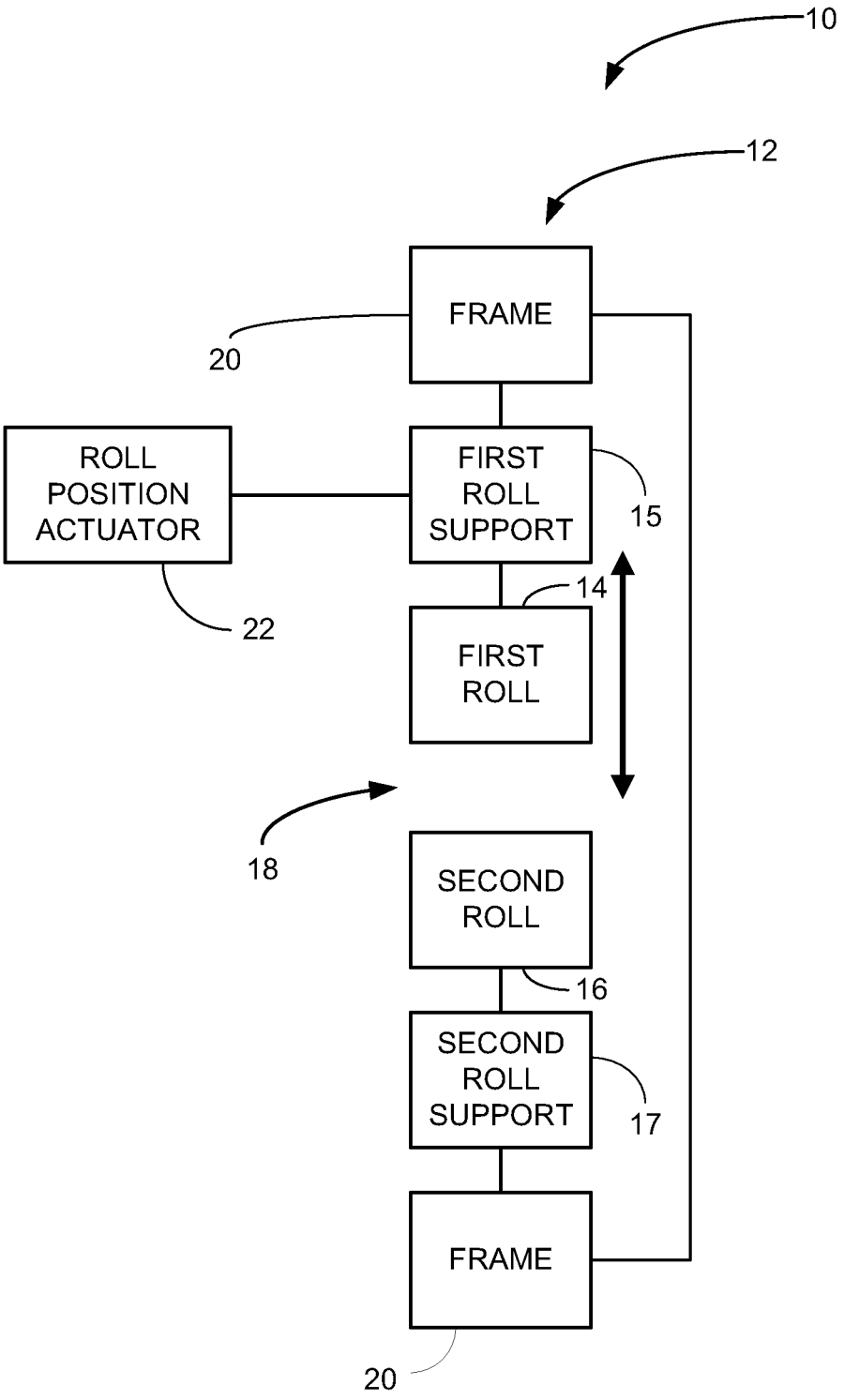
Figure 5:
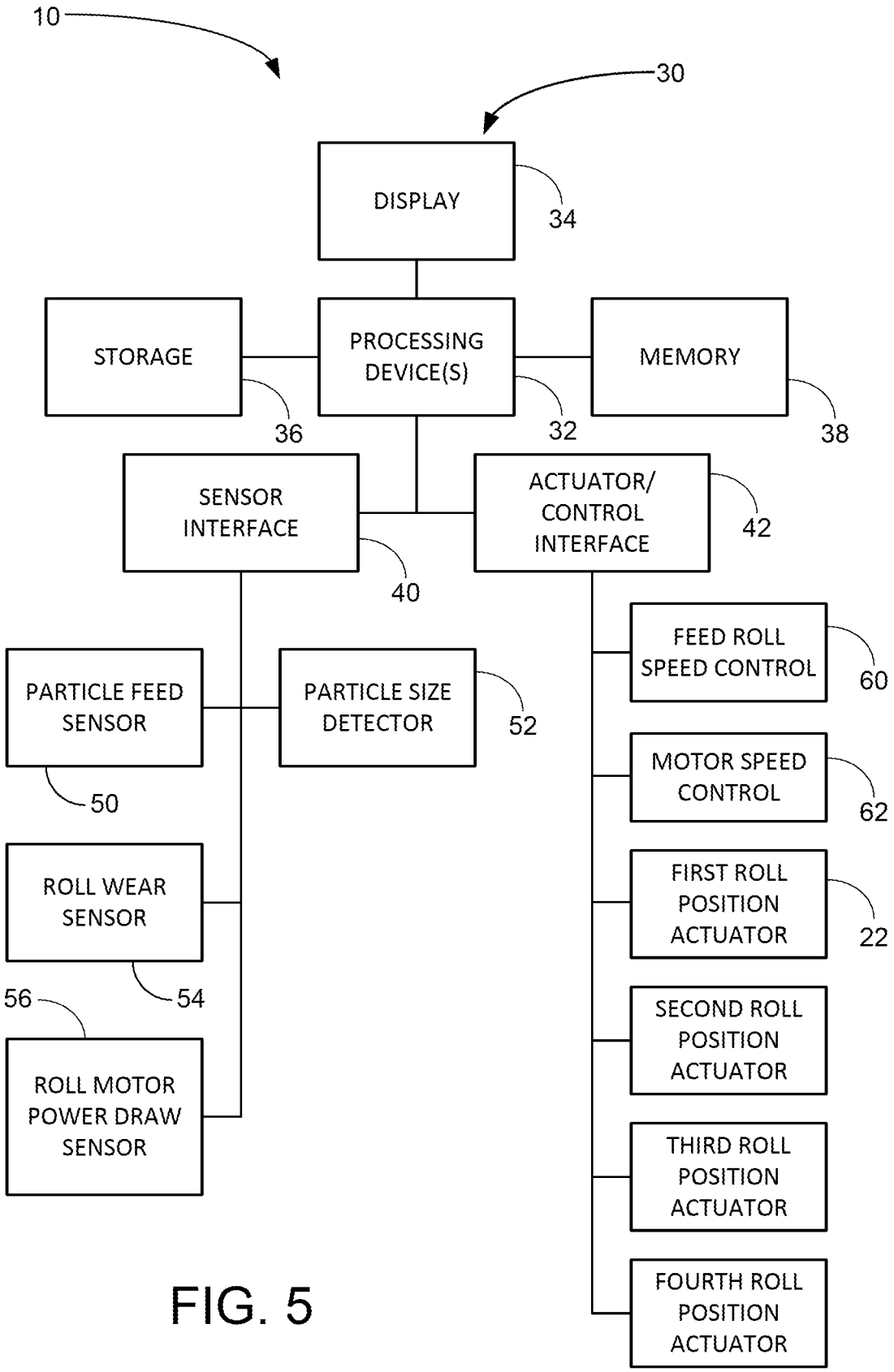

Upon completion of the sub process of FIG. 3, the process may continue as depicted in FIG. 1C with a determination made whether the detected size of the particles is within the desired size range for the current grinding operation (block 128 in FIG. 1C). If so, then the process moves to block 154 in FIG. 1E. If not, then a determination may be made if the grinding rolls are currently adjusted to the maximum roll gap permitted between the rolls (block 130), and if not, then the process moves to the subprocess (block 132) for detecting the power draw of the motors driving the grinding rolls, and adjustment of the rolls, may be performed as depicted in FIG. 2. If it is determined that the grinding rolls are currently adjusted to the maximum gap permitted, then a determination is made if the wear detected on one or more of the rolls exceeds a predetermined maximum wear threshold (block 134) stored in memory, and if so, then the system provides information to the operator that one or more of the rolls needs to be changed (block 136) such as by communication via the display 34.

Figure 1D:
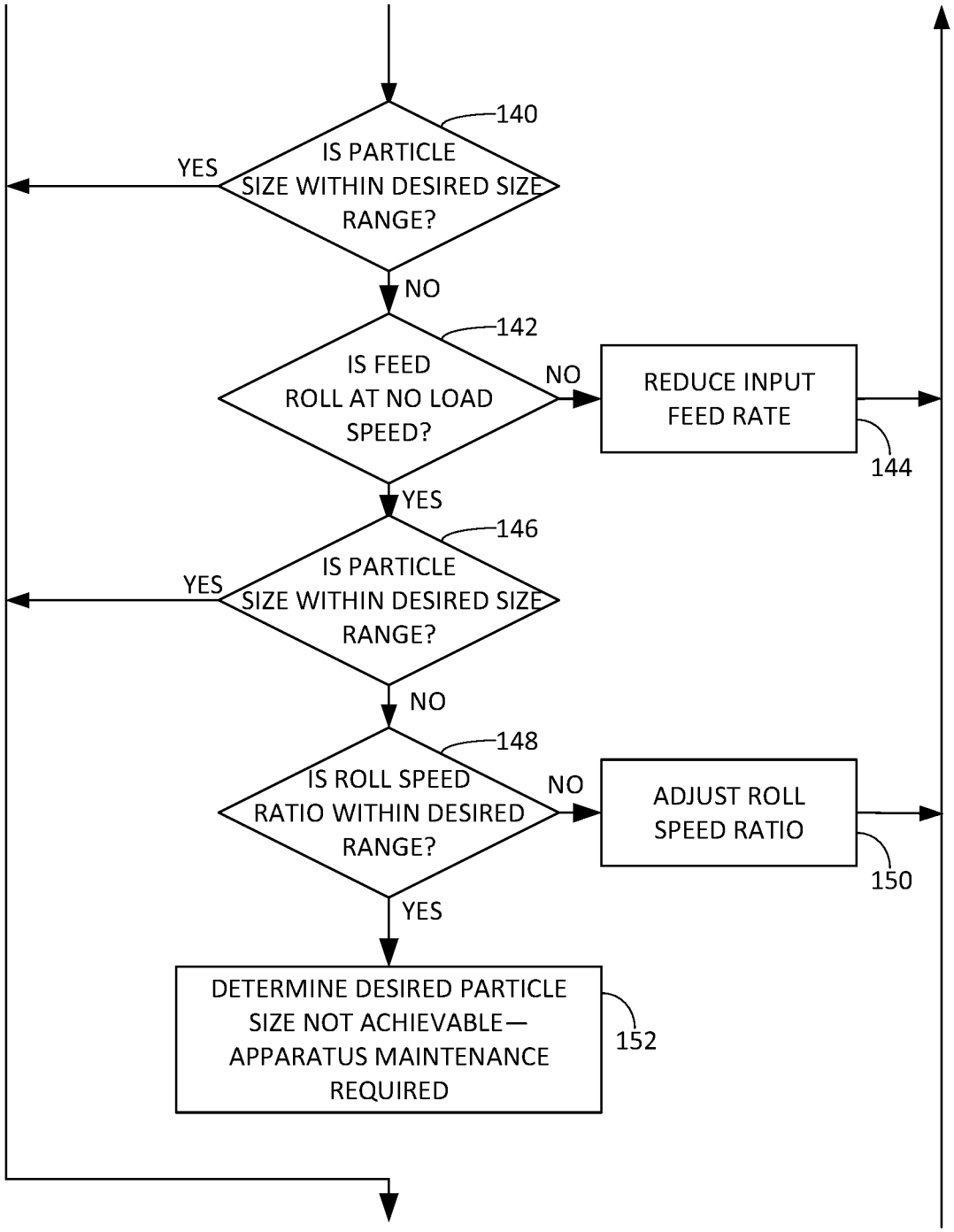

If the detected wear does not exceed the wear threshold, then a determination may be made whether the particle size detected by the particle size detector is within the desired size range (block 140 in FIG. 1D). If so, then the process moves to block 154 in FIG. 1E. If not, then a determination may be made whether the feed roll is rotating at a no-load speed (block 142) via the feed roll speed control, and if not, then the input feed rate may be reduced (block 144), and the process returns to the initial step at block 104 in FIG. 1A. If it is determined that the feed rolls are rotating at a no-load speed (block 142), then a determination is made as to whether the particle size is within the desired size range (block 146) and if so, then then the process moves to block 154 in FIG. E. If not, then a determination is made whether the ratio between the rotational speeds of the rolls is within the desired range stored in memory (step 148). If not, the rotational speed of one or both of the rolls is adjusted to thereby adjust the ratio between the rotational speeds (block 150) to bring the ratio within the desired ratio range, and the process returns to the initial step of block 104 in FIG. 1A. If the ratio of rotational speeds of the rolls is within the desired range, then a determination may be made and communicated to the operator that the desired particle size is likely not achievable under the current apparatus and particle characteristics, and maintenance on the apparatus may be required (block 152).

Figure 1E:
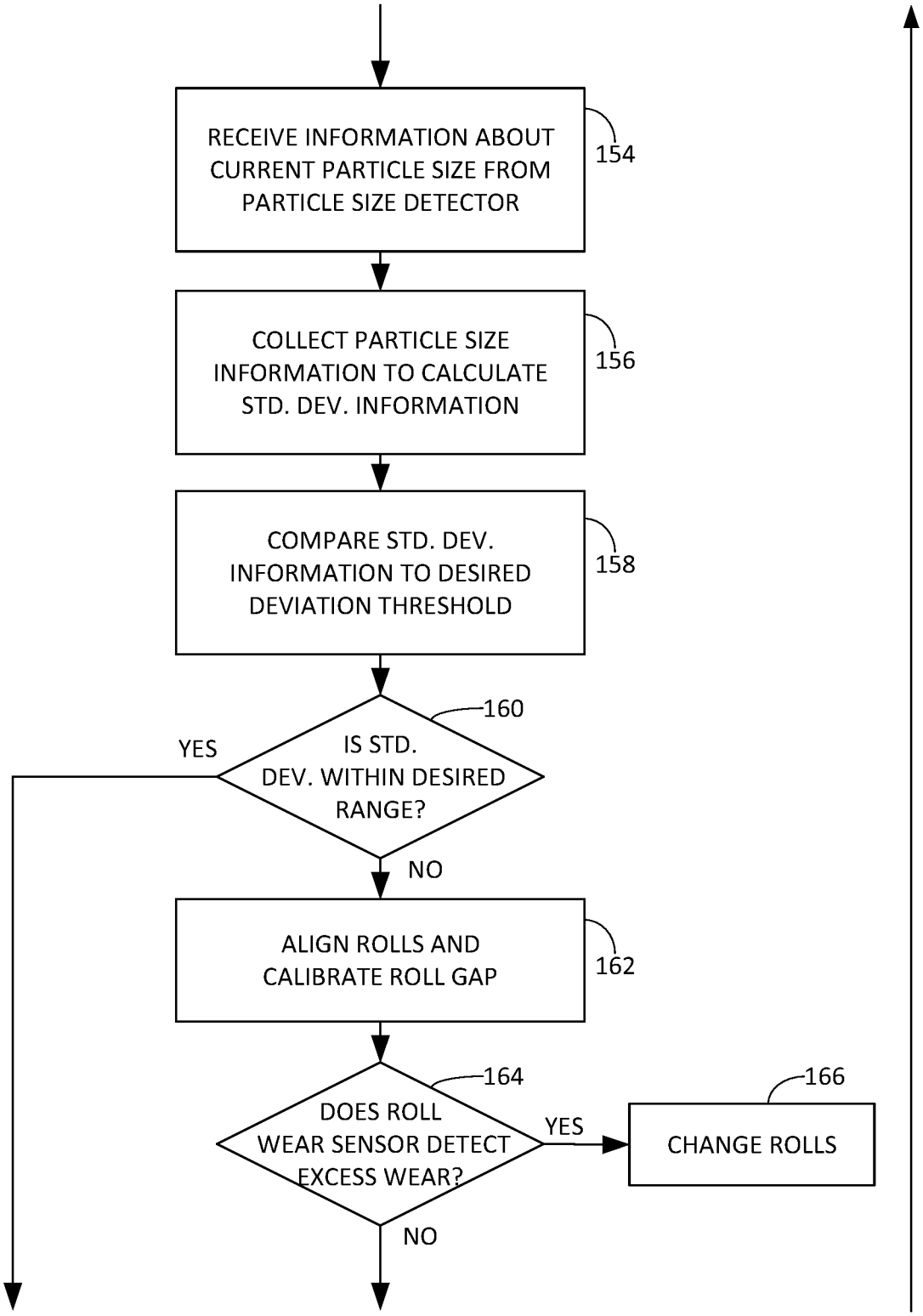

Continuing on to FIG. 1E, current data on a characteristic of the particle size may be received from the particle size detector 52 (block 154) and additional current data may be collected on the characteristic of the sizes of the particles over a predetermined time period so that information on the standard deviation of the particle size may also be calculated (block 156). The calculated standard deviation value may be compared to a desired standard deviation threshold value (block 158), and a determination may be made whether the standard deviation is within a predetermined desired range (block 160) stored in memory. If so, then the process moves to block 200 in FIG. 1H. If the calculated standard deviation is not within the predetermined desired range, then a subprocess (block 162) for aligning the rolls, and calibrating the roll gap between the rolls, may be performed as depicted in FIG. 3. Upon the completion of the sub process, a determination may be made as to whether the wear detected on one or more of the grinding rolls exceeds a predetermined maximum wear threshold (block 164), and if so, then the system provides information to the operator that one or more of the rolls needs to be changed (block 166) and the operator may be notified via the display or other communication means.

Figure 1F:
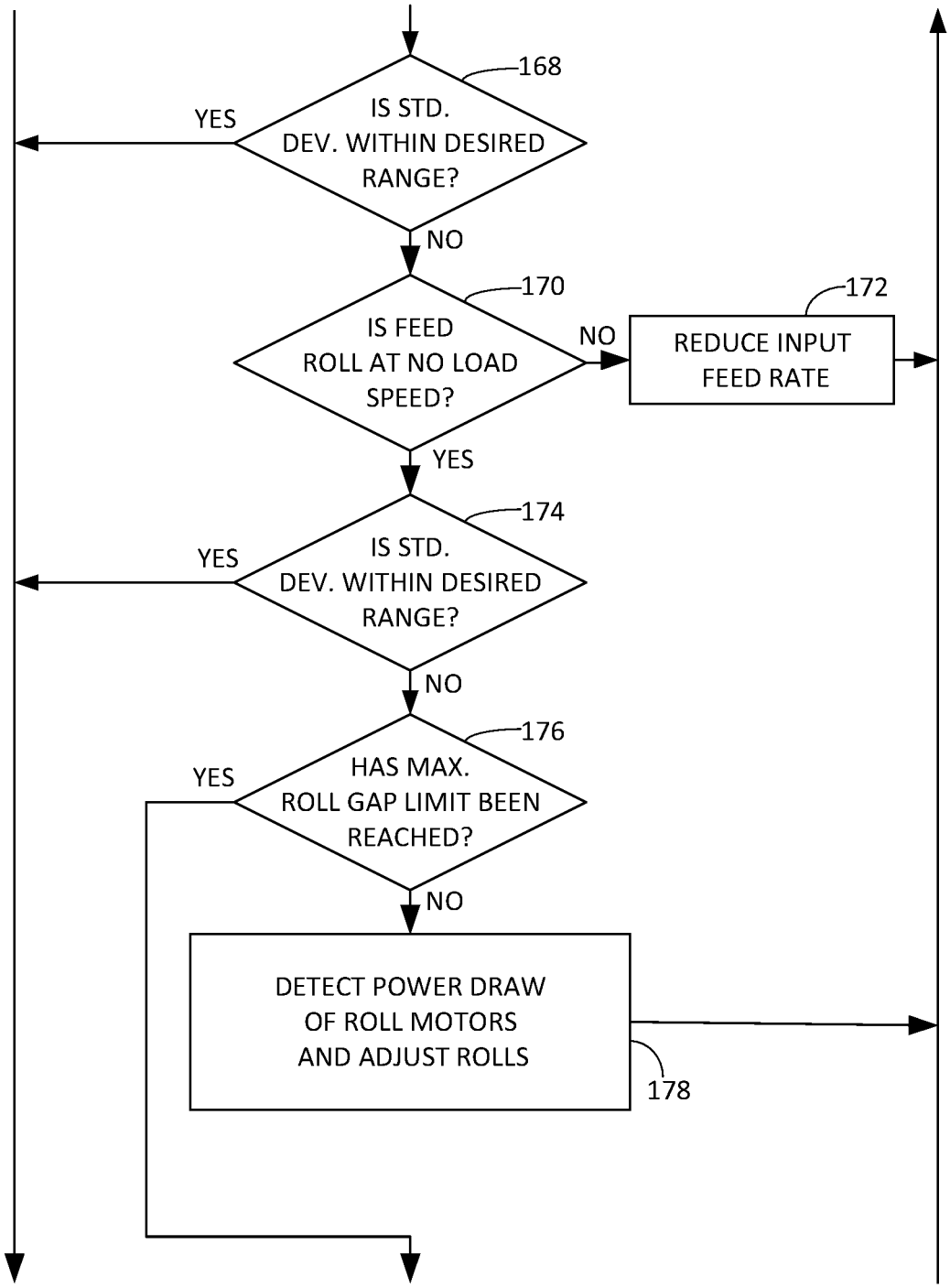
Figure 1G:
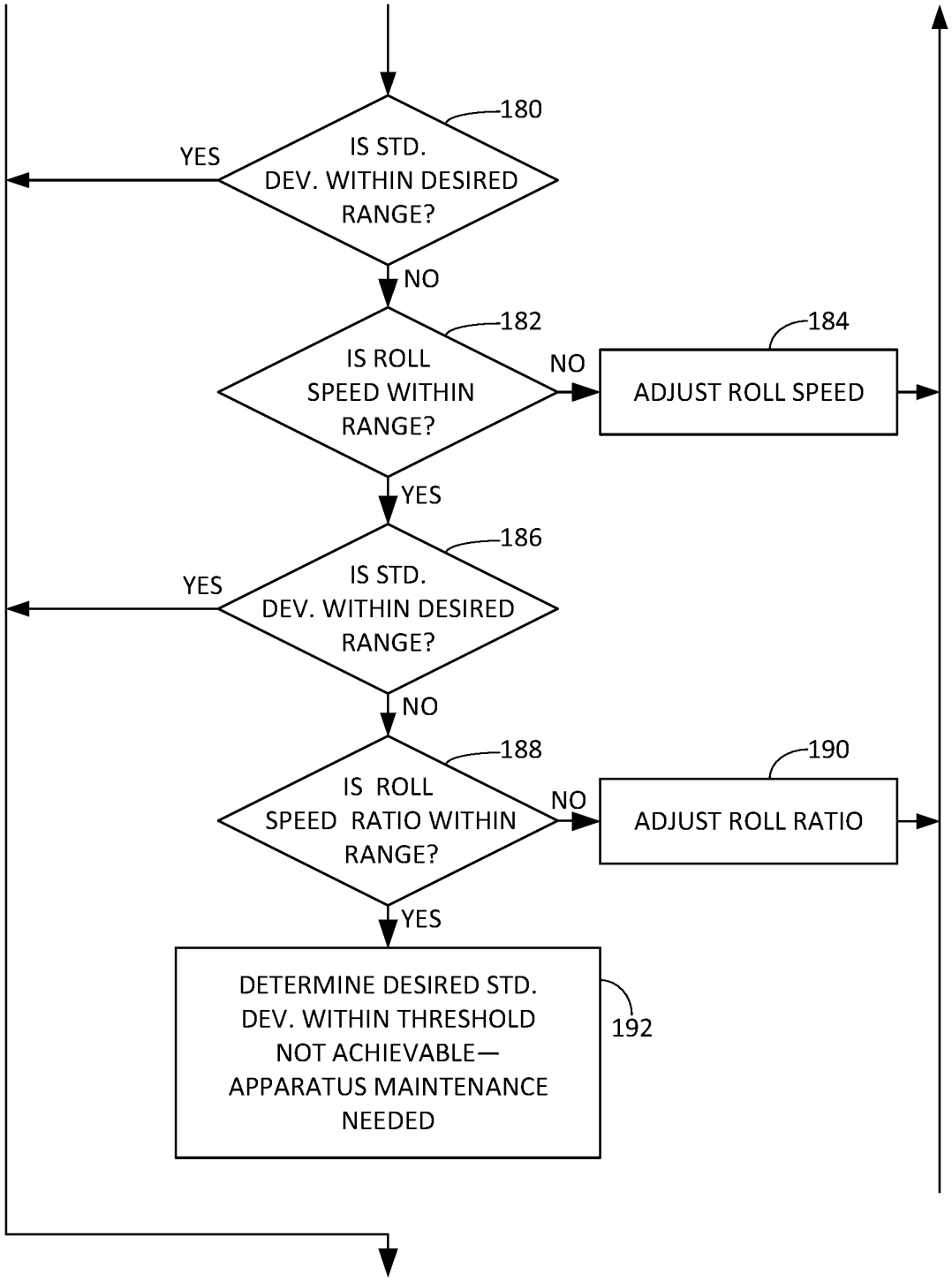

Looking to FIG. 1F, if excess wear on the roll or rolls is not detected, then a determination may be made whether the current standard deviation of the particle size is within the predetermined desired range (block 168). If so, then the process moves to block 200 in FIG. 1H, and if not, then a determination is made whether the feed roll is currently operating at a no-load speed (block 170) via the feed roll speed control 60. If not, then the input feed rate may be reduced (block 172), and the process returns to the initial step at block 104 in FIG. 1A. If it is determined that the feed rolls are rotating at a no-load speed (block 170), then a determination may be made as to whether the standard deviation of the currently detected particle sizes are within the desired range (block 174) and if so, then the process moves to block 200 in FIG. 1H. If not, then a further determination is made whether the grinding rolls 14, 16 are currently adjusted to the maximum gap 18 permitted between the rolls (block 176), and if not, then the process moves to a subprocess (block 178) for detecting the power draw of the motors driving the grinding rolls, and adjustment of the rolls, may be performed as depicted in FIG. 2.

Figure 1H:
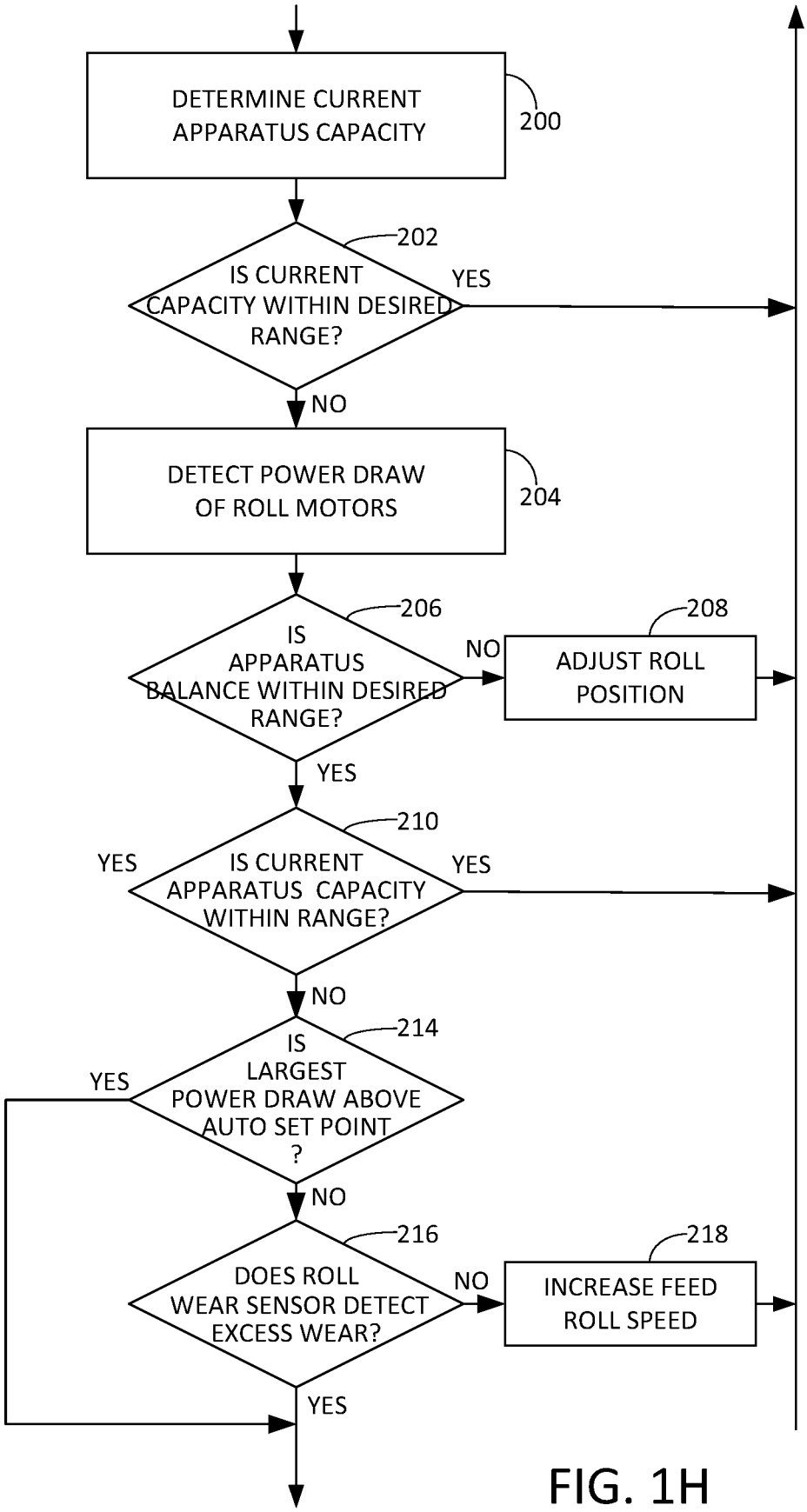
Figure 1I:
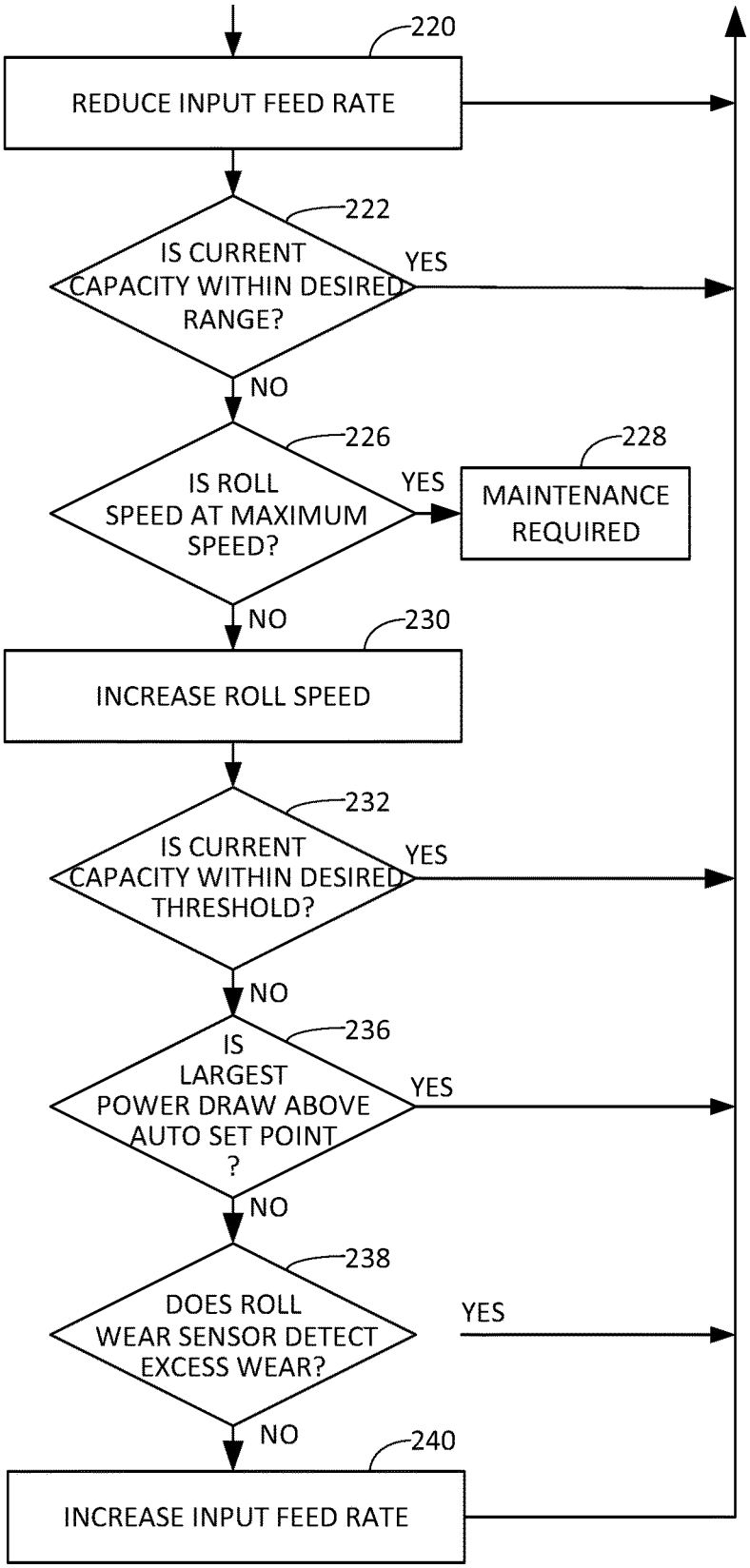

If it is determined that the gap between the grinding rolls has reached the maximum permitted (block 176), then the process moves on to determine whether the standard deviation of the currently detected particle sizes are within the desired range (block 180 in FIG. 1G) and if so, then the process moves to block 200 in FIG. 1H. If not, then a determination is made whether the speed of rotation of one or both rolls is within the desired range for the rotation speed (block 182), and if not, then speed of rotation of the roll or rolls are adjusted to a speed in the desired range (block 184) and the process returns to the initial step at block 104 in FIG. 1A. If the speed is in the desired range, then a determination may be made as to whether the standard deviation of the current particle sizes is within the desired range (block 186), If so, then the process moves to block 200 in FIG. 1H. If not, then a determination is made whether the roll speed ratio is within the desired range (block 188), and if not, then an adjustment of the speed or speeds of the roll or rolls is made via the motor speed control 62 to bring the roll speed ratio within the desired range (block 190) and the process returns to the initial step at block 104 in FIG. 1A. If the roll speed ratio is within the desired range, then a determination may be made and communicated to the operator that a standard deviation of particle size within the desired range is not achievable under the current apparatus and particle characteristics, and maintenance on the apparatus may be required (block 192).

Turning to FIG. 1H, the process continues with an analysis of the current machine capacity (block 200). If it is determined that the current machine capacity is within the desired range stored in memory for this characteristic (block 202), then the process returns to the initial step at block 104 in FIG. 1A. If the current machine capacity is not within the desired range, then an analysis is made of the power draw of the motor or motors of the apparatus that rotate the roll or rolls of the apparatus (block 204). If the power draw of the roll motors is determined to not be balanced among the motors within a desired range stored in memory, then the position of one or both of the rolls being driven by a motor for which the power draw is to be balanced may be adjusted (block 208) in a manner that tends to bring the power draw into balance, and the process returns to the initial step at block 104 in FIG. 1A. If it is determined that the power draw is balanced within the desired range, then it may be further determined whether the current apparatus capacity is within the desired range for the apparatus (block 210). If so, then the process returns to the initial step at block 104 in FIG. 1A. If not, then a determination is made whether the largest power draw of one of the motors rotating the rolls exceeds the auto set point (block 214) which is typically calibrated in terms of a percentage of the full load amperage of the motor. If the largest power draw power draw exceeds the auto set point recorded in memory (e.g. by the operator), then the process moves to block 220 in FIG. 11. If the largest power draw of the motors is not above the auto set point, then a determination may be made whether the roll wear sensor 54 detects excess wear in one or more of the rolls (block 216). If not, the feed roll speed is increased (block 218) by issuing a command to the feed roll speed control 60, and the process returns to the initial step of block 104 in FIG. 1A. If excess wear on a roll is detected (block 216), then the process continues to block 220 in FIG. 11.

The input feed rate may be decreased (block 220) by a command to the feed roll speed control 60, and a determination may be made whether the current capacity being handled by the apparatus is within the desired range (block 222). If it is, then the process returns to the initial step at block 104 in FIG. 1A. If not, then a determination is made whether the rotational speed of the roll or rolls is at or above the maximum speed for the rolls (block 226) by comparing data from the motor speed control to a predetermined maximum roll speed stored in memory, and if it is, then a determination may be made and communicated to the operator that maintenance of the apparatus may be required (block 228). If the rotational speed of the roll or rolls is not at or above the maximum speed (block 226), then the roll speed may be increased (block 230) by a command to the motor speed control 62 controlling the speed of the motor which rotates the roll or rolls. A determination may then be made whether the current capacity being handled by the apparatus is within the desired range (block 232), and if so, then the process returns to the initial step at block 104 in FIG. 1A. If not then a determination is made whether the largest power draw of one of the motors rotating the rolls is above the auto set point (block 236), and if so, then the process returns to the initial step of block 104 in FIG. 1A. If not, then a determination may be made whether the roll wear sensor detects excess wear in one or more of the rolls (block 238), and if so, then the process returns to the initial step at block 104 in FIG. 1A. If not, then the feed roll speed is increased (block 240) by issuing a command to the feed roll speed control, and then the process returns to the initial step at block 104 in FIG. 1A.

An illustrative subprocess 300 for adjusting the gap between the pairs of rolls of a grinding apparatus based in at least part upon the power draw of the motor or motors driving the grinding roll or rolls of the apparatus is depicted in FIG. 2. The subprocess 300 is called upon at various stages of the implementation 100 with a determination of whether the current particle size is larger than the target size or range of sizes (block 302). If the current particle size is larger, then the gap of at least one pair of grinding rolls is made smaller. Initially, a determination is made whether the motor of a first roll pair has the lowest power (or amp) draw (block 304) and if so the gap between the pair of rolls in roll pair 1 is narrowed (block 306) and the process 100 is resumed at the point subprocess 300 was initiated. If the power draw of the first roll pair (block 304) was not the lowest draw, then a determination is made whether the motor of a second roll pair has a lowest power draw (block 308), and if so the gap between the pair of rolls in roll pair 2 is narrowed (block 310) and the process 100 is resumed at the point subprocess 300 was initiated. If the power draw of the second roll pair (block 308) was not the lowest power draw, then a determination is made whether the motor of a third roll pair has the lowest power draw (block 312), and if so, the gap between the pair of rolls in roll pair 3 is narrowed (block 314) and the process 100 is resumed at the point subprocess 300 was initiated. If the power draw of the third roll pair (block 312) was not the lowest power draw, then a determination is made whether the motor of a fourth roll pair as the lowest power draw (block 316), and if so, the guy between the pair of rolls in roll pair 4 is narrowed (block 318) and the process 100 is resumed at the point subprocess 300 was initiated. These aspects of subprocess 300 may be repeated for any additional motors driving additional roll pairs.

If it is determined that the current particle size is not larger than the target size or range of sizes (block 302), then it may be determined that the current particle size is smaller than the target size or range of sizes and a determination may be made whether the power draw of the first roll pair has the highest power (or amperage) draw (block 322), and if so then the gap between the pair of rolls in roll pair 1 is widened (block 324) and the process 100 is resumed at the point subprocess 300 was initiated. If the power draw of the first roll pair (block 322) was not the highest draw, a determination is made whether the motor of the second roll pair has the highest power draw (block 326) and if so, the gap between the pair of rolls in roll pair 2 is widened (block 328) and the process 100 is resumed at the point subprocess 300 was initiated. If the power draw of the second roll pair (block 326) was not the highest draw, a determination is made whether the motor of the third roll pair has the highest power draw (block 330) and if so, the gap between the pair of rolls in roll pair 3 is widened (block 332) and the process 100 is resumed at the point subprocess 300 was initiated. If the power draw of the third roll pair (block 330) is not the highest draw, a determination is made whether the motor of the fourth roll pair has the highest power draw (block 334), and if so, the gap between the pair of rolls in roll pair 4 is widened (block 336) and the process 100 is resumed at the point subprocess 300 was initiated. These aspects of subprocess 300 may be repeated for any additional motors driving additional roll pairs.

An illustrative subprocess 400 for calibrating the position of the rolls of a pair of rolls of the apparatus to facilitate alignment of the rolls with a uniform roll gap between the pair of rolls is depicted in FIG. 3. In a broad sense, aligning and calibrating the positions of a pair of rolls may be accomplished by bringing the rolls together such that the rolls come into contact with a "zero" gap between the rolls. In an illustratively configured apparatus 12, the first roll 14 is supported by the roll support 15 in a manner such that the roll 14 is movably mounted on the frame 20, and the second roll 16 is supported by the roll support 17 and manner such that the role 16 is stationary on the frame 20.

Initially, a first set of corresponding first ends of the rolls of the pair of grinding rolls may be brought together by moving the first end of the movable roll toward the first end of the stationary roll until the first ends of the rolls come into contact (block 402). The position of the first end of the movable roll is recorded as the "zero" point, or location of the first end of the roll when there is zero gap between the rolls (block 404). Then, a second set of corresponding second ends (which are opposite of the first set of corresponding first ends on the rolls) are brought together by moving the second end of the movable roll toward the second end of the stationary roll until the second ends of the rolls come into contact (block 406). The position of the second end of the movable roll is recorded as the "zero" point, or location of the second end of the roll when there is zero gap between the rolls (block 408). The recorded zero points may be used to adjust the gaps between the respective ends so that the rotation axes of the rolls are aligned and as a result the gap between the rolls is uniform from the first ends of the rolls to the second ends of the rolls (block 410).

In some implementations, at least one of the rolls is rotating when the ends of the rolls are brought into contact, although in other implementations rotation of one or both rolls may not be utilized. Any suitable manner of detecting contact between the ends may be utilized, such as the audible noise caused by contact between the surfaces (or teeth) of the rotating rolls, or other techniques, such as the techniques disclosed in U.S. Pat. No. 9,919,315 issued Mar. 20, 2018 which is hereby incorporated by reference in its entirety.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A particle grinding apparatus for grinding particles entering an input of the apparatus and passing the particles with reduced sizes to an output of the apparatus, the apparatus comprising:

a frame;

at least one pair of grinding rolls with each grinding roll having a plurality of grinding teeth thereon, the rolls being separated by a roll gap through which the particles pass;

a roll support mounting each of the rolls on the frame, at least one of the roll supports being movable with respect to the frame to move the associated roll of the roll pair of rolls with respect to another roll of the pair of rolls to adjust a size of the roll gap;

a motor configured to rotate at least one of the rolls of the at least one pair of grinding rolls, the motor being mounted on the frame;

a control assembly configured to control operation of the apparatus, the control assembly comprising:

a sensor assembly including at least one sensor and a sensor interface for receiving data signals from the at least one sensor to sense an aspect of the operation of the apparatus, the at least one sensor comprising a particle size detector configured to sense a characteristic size of the particles passing through a point in the apparatus;

an actuator assembly including at least one actuator and an actuator interface for sending command signals to the at least one actuator to make adjustments of elements of the apparatus, the at least one actuator comprising a roll position actuator configured to act on the at least one pair of grinding rolls;

a processor in communication with the sensor interface to receive the data signals from the at least one sensor and communicate with the actuator interface to send the command signals to the at least one actuator; and a memory device configured to store data including data relating to a target particle size range for particles output by the apparatus;

wherein the processor is configured to:

receive data from the particle size detector regarding the characteristic size of the particles currently sensed by the particle size detector;

compare the characteristic size of the particles currently sensed by the particle size detector to the target particle size range;

determine if the characteristic size of the particles currently sensed by the particle size detector is in the target particle size range, and if the characteristic size of the particles currently sensed by the particle size detector is not in the target particle size range, cause the roll position actuator to adjust the gap between the rolls of the apparatus.

2. The apparatus of claim 1 wherein the roll position actuator is configured to act on the movable roll support to adjust a size of the roll gap between the rolls; and wherein the processor is configured to:

if the current characteristic size of the particles is smaller than the target particle size range, then operate the roll position actuator to widen the roll gap between the pair of rolls; and if the current characteristic size of the particles is greater than the target particle size range, then operate the roll position actuator to narrow the roll gap between the pair of rolls.

3. An apparatus for reducing sizes of particles entering an input of the apparatus and passing the particles of reduced sizes to an output of the apparatus, the apparatus comprising:

a frame;

at least one pair of grinding rolls with each grinding roll having a plurality of grinding teeth thereon, the rolls being separated by a roll gap through which the particles pass;

a roll support mounting each of the rolls on the frame, at least one of the roll supports being movable with respect to the frame to move the associated roll of the roll pair of rolls with respect to another roll of the pair of rolls to adjust a size of the roll gap;

a motor configured to rotate at least one of the rolls of the at least one pair of grinding rolls, the motor being mounted on the frame;

a control assembly configured to control operation of the apparatus, the control assembly comprising:

a sensor assembly including at least one sensor and a sensor interface for receiving data signals from the at least one sensor to sense an aspect of the operation of the apparatus, the at least one sensor comprising a particle size detector configured to sense a characteristic size of the particles passing through a point in the apparatus;

an actuator assembly including at least one actuator and an actuator interface for sending command signals to the at least one actuator to make adjustments of elements of the apparatus, the at least one actuator comprising a roll position actuator configured to act on the at least one pair of grinding rolls;

a processor in communication with the sensor interface to receive the data signals from the at least one sensor and communicate with the actuator interface to send the command signals to the at least one actuator; and a memory device configured to store data including data relating to a target particle size range for particles output by the apparatus;

wherein the at least one pair of grinding rolls comprises a first pair of grinding rolls, and the motor comprises a first motor configured to rotate at least one grinding roll of the first pair of rolls;

wherein the apparatus includes:

a first roll motor power sensor configured to sense a level of power drawn by the first motor to rotate at least one of the grinding rolls of the first pair of grinding rolls;

a second said pair of grinding rolls;

a second said roll position actuator of the actuator assembly configured to act on the second pair of grinding rolls;

a second motor configured to rotate at least one grinding roll of the second pair of rolls;

a second roll motor power sensor configured to sense a level of power drawn by the second motor to rotate at least one of the grinding rolls of the second pair of grinding rolls; and wherein the processor is configured to:

compare the characteristic size of the particles sensed by the particle size detector to the target particle size range;

if the characteristic size of the particles is larger than the target particle size range, then determine a power draw of each of the first and second motors;

if the first motor has a lower power draw of the first and second motors, then operate the first roll position actuator to narrow the roll gap between the first pair of rolls; and if the second motor has a lower power draw of the first and second motors, then operate the second roll position actuator to narrow the roll gap between the second pair of rolls.

4. The apparatus of claim 3 wherein the processor is configured to:

compare the characteristic size of the particles sensed by the particle size detector to a target particle size range;

if the characteristic size of the particles is smaller than the target particle size range, then determine a power draw of each of the first and second motors; and if the first motor has a greater power draw of the first and second motors, then operate the first roll position actuator to widen the roll gap between the first pair of rolls; and if the second motor has a greater power draw of the first and second motors, then operate the second roll position actuator to widen the roll gap between the second pair of rolls.

5. An apparatus for reducing sizes of particles entering an input of the apparatus and passing the particles of reduced sizes to an output of the apparatus, the apparatus comprising:

a frame;

at least one pair of grinding rolls with each grinding roll having a plurality of grinding teeth thereon, the rolls being separated by a roll gap through which the particles pass;

a roll support mounting each of the rolls on the frame, at least one of the roll supports being movable with respect to the frame to move the associated roll of the roll pair of rolls with respect to another roll of the pair of rolls to adjust a size of the roll gap;

a motor configured to rotate at least one of the rolls of the at least one pair of grinding rolls, the motor being mounted on the frame;

a control assembly configured to control operation of the apparatus, the control assembly comprising:

a sensor assembly including at least one sensor and a sensor interface for receiving data signals from the at least one sensor to sense an aspect of the operation of the apparatus, the at least one sensor comprising a particle size detector configured to sense a characteristic size of the particles passing through a point in the apparatus;

an actuator assembly including at least one actuator and an actuator interface for sending command signals to the at least one actuator to make adjustments of elements of the apparatus, the at least one actuator comprising a roll position actuator configured to act on the at least one pair of grinding rolls;

a processor in communication with the sensor interface to receive the data signals from the at least one sensor and communicate with the actuator interface to send the command signals to the at least one actuator; and a memory device configured to store data including data relating to a target particle size range for particles output by the apparatus;

wherein the data stored on the memory device of the control assembly includes data relating to a maximum roll gap limit of the roll gap and a maximum wear threshold of wear on at least one grinding roll of the pair of grinding rolls;

wherein the at least one sensor of the sensor assembly additionally comprises a roll wear sensor configured to sense a degree of wear on at least one of the grinding rolls of the pair of grinding rolls;

wherein the processor is configured to:

receive data from the particle size detector regarding the characteristic size of the particles currently sensed by the particle size detector;

compare the characteristic size of the particles to the target particle size range;

determine if the characteristic particle size is in the target particle size range, and if the characteristic particle size is larger than the desired particle size range, then determine if the maximum roll gap limit of a size of the roll gap has been reached; and if the maximum roll gap limit has been reached, then determine if at least one grinding roll of the pair of grinding rolls has reached the maximum wear threshold of the grinding rolls.

6. An apparatus for reducing sizes of particles entering an input of the apparatus and passing the particles of reduced sizes to an output of the apparatus, the apparatus comprising:

a frame;

at least one pair of grinding rolls with each grinding roll having a plurality of grinding teeth thereon, the rolls being separated by a roll gap through which the particles pass;

a roll support mounting each of the rolls on the frame, at least one of the roll supports being movable with respect to the frame to move the associated roll of the roll pair of rolls with respect to another roll of the pair of rolls to adjust a size of the roll gap;

a motor configured to rotate at least one of the rolls of the at least one pair of grinding rolls, the motor being mounted on the frame;

a control assembly configured to control operation of the apparatus, the control assembly comprising:

a sensor assembly including at least one sensor and a sensor interface for receiving data signals from the at least one sensor to sense an aspect of the operation of the apparatus, the at least one sensor comprising a particle size detector configured to sense a characteristic size of the particles passing through a point in the apparatus;

an actuator assembly including at least one actuator and an actuator interface for sending command signals to the at least one actuator to make adjustments of elements of the apparatus, the at least one actuator comprising a roll position actuator configured to act on the at least one pair of grinding rolls;

a processor in communication with the sensor interface to receive the data signals from the at least one sensor and communicate with the actuator interface to send the command signals to the at least one actuator; and a memory device configured to store data including data relating to a target particle size range for particles output by the apparatus;

wherein the data stored on the memory device of the control assembly includes data relating to a desired range of standard deviation threshold values; and wherein the processor is configured to:

receive additional data from the particle size detector regarding the characteristic size of the particles over a time period;

calculate a standard deviation value of the characteristic size of the particles based upon the additional data regarding the characteristic size of the particles over the time;

compare the standard deviation value of the characteristic size of the particles to the desired range of standard deviation threshold values; and if the standard deviation value of the characteristic size of the particles is not in the desired range of standard deviation values, cause the roll position actuator to adjust the gap between the rolls of the apparatus.

7. The apparatus of claim 6 wherein the adjustment of the gap between the rolls of the apparatus comprises calibrating the gap between the rolls.

8. The apparatus of claim 6 wherein the at least one sensor of the sensor assembly is a roll wear sensor configured to sense a degree of wear on at least one of the grinding rolls of the pair of grinding rolls;

wherein the processor is configured to:

determine whether wear on the at least one grinding roll sensed by the roll wear sensor exceeds a wear threshold; and if the wear on the at least one grinding roll exceeds the wear threshold, then provide a message to an operator of the apparatus that at least one grinding roll of the pair of grinding rolls needs to be replaced.

* * * * *